United States Patent [19]

Hoover

[11] Patent Number: 4,994,862

[45] Date of Patent: Feb. 19, 1991

[54] FUSING STATION HAVING RELEASE OIL APPLICATION CARTRIDGE

[75] Inventor: Linn C. Hoover, Rochester, N.Y.

[73] Assignee: Eastman Kodak Company, Rochester, N.Y.

[21] Appl. No.: 451,845

[22] Filed: Dec. 18, 1989

[51] Int. Cl.[5] ..... G03G 15/20

[52] U.S. Cl. ..... 355/284; 118/60

[58] Field of Search ..... 118/249, 248, 258, 260, 118/259, 60; 355/282, 284, 285, 293

[56] References Cited

U.S. PATENT DOCUMENTS

| | | | |
|---|---|---|---|
| 3,982,832 | 9/1976 | Bendall et al. | 355/221 |
| 4,393,804 | 7/1983 | Nygard et al. | 118/70 |
| 4,757,347 | 7/1988 | Tamaoki et al. | 355/284 |
| 4,870,445 | 9/1989 | Collier et al. | 355/282 |
| 4,870,446 | 9/1989 | Bickerstaff et al. | 355/282 |

FOREIGN PATENT DOCUMENTS 1399740 7/1975 United Kingdom .

*Primary Examiner*—A. T. Grimley
*Assistant Examiner*—Sandra L. Hoffman
*Attorney, Agent, or Firm*—Tallam I. Nguti

[57] ABSTRACT

A fuser and pressure roller type fusing apparatus for fusing toner images onto a suitable receiver in an electrostatographic copier or printer includes a passive release oil application cartridge for positively supplying and applying release oil to the surface of the fuser roller therein. The cartridge includes a release oil reservoir, a release oil application roll which contacts and is driven by the rotation of the fuser roller, and an oil feeding and pumping assembly for delivering oil from the reservoir to the application roll.

5 Claims, 1 Drawing Sheet

FUSING STATION HAVING RELEASE OIL APPLICATION CARTRIDGE

BACKGROUND OF THE INVENTION

This invention relates to fuser and pressure roller type fusing stations for fusing toner images in electrostatographic copiers and printers. More particularly, the invention relates to such a fusing station that includes an easy, inexpensive, and clean method and apparatus for applying release oil to the surface of the fuser roller of such station.

Fuser and pressure roller type fusing stations, for fusing toner images on a suitable receiver in electrostatographic copiers and printers, are well known. Usually the fuser roller of such stations is heated. It rotatably forms a fusing nip with the pressure roller, and the receivers with unfused toner images thereon are passed through such fusing nip such that the surface of the heated fuser roller directly contacts and heats the toner images being fused.

A common problem associated with such fusing stations is the offsetting of the toner images being fused from the receiver onto the surface of the fuser roller. In order to prevent such offsetting, it is well known to apply a release oil, such as silicone oil, to the surface of the rotating fuser roller. Some of the various conventional methods and apparatus for applying such oil to the surface of the fuser roller are disclosed, for example, in U.S. Pat. No. 3,982,832, issued to Bendall et al. on Sep. 28, 1976, and U.S. Pat. No. 4,393,804, issued to Nygard et al on July 19, 1983, as well as in Great Britain Patent Specification No. 1,399,740, Published July 2, 1975. Typically, the conventional apparatus disclosed each include a member for applying the oil to fuser roller, and a supply source, for example, a replenishment bottle, for the oil. The oil applying member must occasionally be replaced by an ordinary operator, who must frequently also renew the supply source of oil. Furthermore, each such conventional apparatus includes a separate and dedicated drive means, such as a motor, for powering the means for feeding the oil from the supply source to the oil applying member.

Such conventional apparatus are expensive, and are often difficult for ordinary operators to handle. Particularly, such handling can be messy, especially given separate and individual handling of replenishment bottles of oil, as well as, of spent and oil-soaked release oil application members.

SUMMARY OF THE INVENTION

It is an object of the present invention to provide a fuser and pressure roller type fusing station in an electrostatographic copier or printer that includes an easy, inexpensive and clean method and apparatus for applying release oil to the fuser roller of the station.

In accordance with the present invention, a fusing station for fusing toner images on a receiver in an electrostatographic copier or printer includes a fuser roller, means for heating the fuser roller, a pressure roller in nip engagement with the fuser roller, and a release oil application cartridge for supplying and applying release oil to the surface of the fuser roller. The release oil application cartridge comprises a housing that includes a front wall having an opening therein, and a rotatable shaft that is supported in the housing adjacent such opening. The cartridge further includes a rotatable release oil application roll for receiving and applying release oil to the outside surface of the fuser roller.

The application roll is mounted fixedly to the shaft for rotation therewith, and is positioned across the opening in the front wall so that it projects partially through the opening, and frictionally contacts the outside surface of the fuser roller for applying release oil thereto, and for being driven thereby. The cartridge also includes a reservoir of release oil which is mounted within an upper portion of the housing, as well as, feed means that are located beneath the reservoir, connecting the reservoir to the application roll. The feed means include a flow tube and a cam driven pressure bar assembly for intermittently compressing and releasing the flow tube so as to force release oil therein into the application roll for application to the surface of the fuser roller.

BRIEF DESCRIPTION OF THE DRAWING

In the detailed description of the invention presented below, reference is made to the drawing in which.

DETAILED DESCRIPTION OF THE INVENTION

Figure 1:
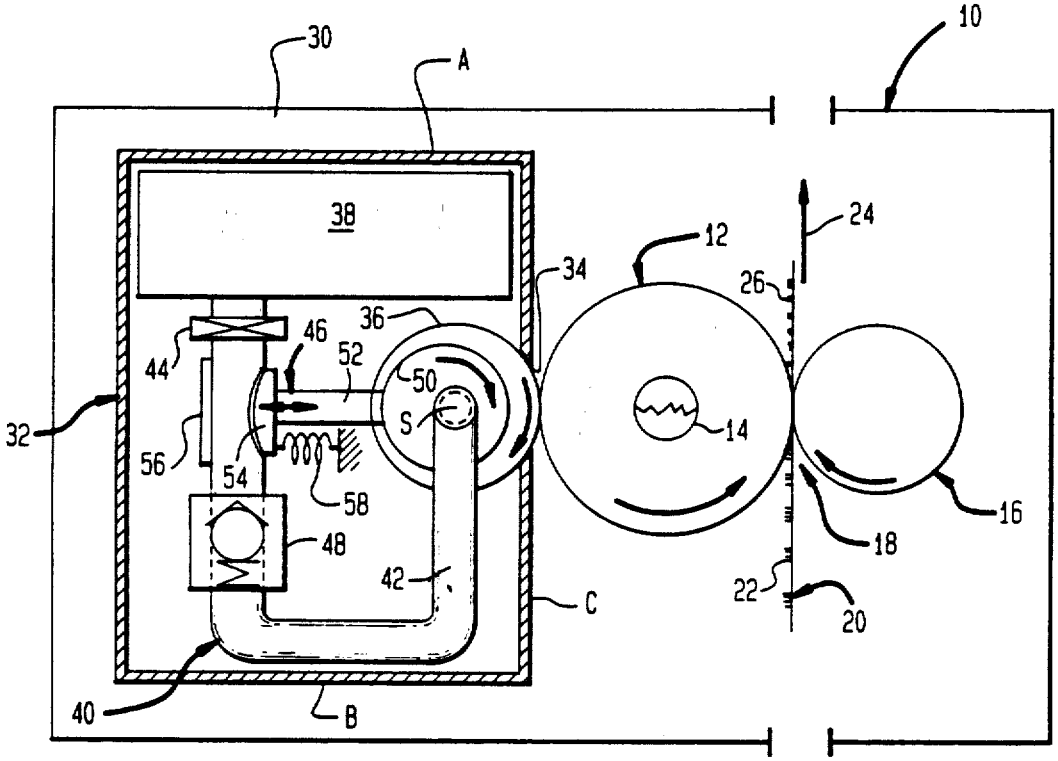
FIG. 1 is an elevational end view schematic of the development station of the present invention.

Referring to the drawing, a fuser and pressure roller type fusing station in an electrostatographic copier or printer is shown generally as 10, and includes a rotatable fuser roller 12, means 14, such as a quartz lamp for heating the fuser roller, and a rotatable pressure roller 16 forming a fusing nip 18 with the fuser roller 12. As is well known, the fuser and pressure rollers 12 and 16 should have constructions suitable for producing clean, desirable fused images on receivers such as copy sheets of paper 20. The fuser roller 12 may also be heated externally by suitable means.

The fusing station 10 is used in an electrostatographic copier or printer to fuse unfused toner images 22 on the suitable receiver 20 being passed in the direction of arrow 24 through the fusing nip 18 such that the heated fuser roller 12 directly contacts and heats the unfused toner images 22. The quality of fused images 26 exiting the nip 18 depends in significant part on the toner images 22 not offsetting to the surface of the fuser roller 12 during such fusing.

To prevent such offsetting of the toner images, the fusing station 10 accordingly further includes a release oil application cartridge generally designated 30. The cartridge 30 contains a substantial supply of release oil, such as silicone oil, and applies such oil to the surface of the heated fuser roller 12. The cartridge 30 and its method of use as part of the fusing station 10, are inexpensive, easy and clean. The cartridge is designed to be self-contained and passive, and to have a simple snap-in attaching or loading means (not shown) which form part of the outside surface of the cartridge housing, for loading it into the fusing station 10.

As shown, the cartridge 30 includes a housing 32 that consists at least of a top wall A, a bottom wall B and a front wall C. The front wall C has an opening 34 therein through which a release oil application roll 36 (inside the housing 32) partially projected to contact the surface of the fuser roller 12 when the cartridge 30 is properly attached or loaded in the fusing apparatus 10 for operation.

The cartridge 30 further includes a reservoir 38 Of the release oil, the release oil application roll 36, and means 40 for automatically feeding the release oil from the reservoir 38 to the application roll 36. The reservoir 38, as shown, is mounted in the top portion of the housing 32 adjacent to the top wall A, and is connected by a tube 42 to the application roll 36. The tube 42, as such, is part of the feed means 40.

The release oil application roll 36 is mounted fixedly on a rotatable shaft S inside the housing 32 across the opening 34 such that the roll 36 projects partially through the opening 34 to frictionally contact the surface of the fuser roller. Mounted as such, rotation of the fuser roller 12 frictionally drives the application roll 36, thereby causing the roll 36 to continuously apply release oil thereon. Additionally, such frictional rotation of the application roll 36 also in turn rotates the shaft S which is fixedly connected thereto.

Such rotation of the shaft S is utilized in the present invention, by the ordinarily passive feed means 40, to positively feed release oil from the reservoir 38 to the application roll 36. As such, there is no need for a separate drive means for effecting such feeding.

As shown, the feed means 40 is located within the housing 32 below the reservoir 38, and includes the feed tube 42. The feed means 40 also includes a one-way check valve 44, a cam driven pressure bar assembly 46, a relief valve 48, and a cam 50 cooperating with the pressure bar assembly 46. The cam driven pressure bar assembly 46 is mounted for contacting the tube 42 below the check valve 44. The assembly 56 includes a pressure bar 52 that has a tail or first end, and a large arcuate head 54 for directly contacting the tube 42, a stationary pressure plate 56, and a return spring 58 that is connected to the moving head 54 of the pressure bar 52. The pressure bar 52 is movable and has a tube compressing position and a tube release position relative to the tube 42. The pressure plate 56 is mounted on the side of the tube 52 that is directly across from and opposite the point of contact between the tube 42 and the head 54 of bar 52. The spring 58 functions to return the pressure bar 52 from its tube compressing position to its tube release position when the bar is released by cam 50.

The cam 50, like the application roller 36, is also mounted fixedly on the shaft S for rotation therewith. As mounted, the cam 50 is in continuous rotating contact with the first or tail end of the pressure bar 52 for intermittently driving the pressure bar 52 from its tube release position into compressing contact with the feed tube 42. Such compressing and squeezing contact with the tube 42 pumps release oil within the tube to the application roll 36. The feed means 40 is arranged such that the one-way check valve 44 is disposed in the tube 42 immediately below the reservoir 38 in order to allow gravitational flow of oil from the reservoir into the portion of the tube below, while also preventing backflow of such oil when the tube is compressed by the pressure bar 52 as above.

In the present invention, when the self-contained passive cartridge 30 is properly snap-in-loaded in the fusing station 10, rotation of the fuser roller 12 for fusing toner images as above, also operates to frictionally rotate the application roll 36 in contact therewith, for applying release oil to the surface of the fuser roller 12. Such frictional rotation of the application roll 36 in turn also rotates the shaft S to which the roll 36 is fixedly mounted. Such rotation of the shaft S then in turn rotates the cam 50 which is also fixedly mounted thereto for rotation therewith.

Rotation of the cam 50 as such, cooperates with the action of the spring 58 to move the pressure bar 52 (which is connected to the spring 58 and is in constant contact with the rotating cam 50) back and forth into and out of intermittent compressing contact with the tube 42, against the stationary pressure plate 56. Due to the operation of the valves 44 and 48, particularly the one-way check valve 44, such compression of the tube 42 forces, that is, pumps the release oil therein to the application roller 36 but not back into the reservoir 38.

The method of the present invention for supplying and applying release oil to the surface of the fuser roller 12 therefore simply involves attaching or loading the cartridge 30 into the fusing station 10, and then rotating the fuser roller 12 in order to operate the cartridge in the manner just described.

The cartridge 30 may further include sensor means (not shown) for indicating the condition of an empty reservoir 38. Such a sensor can be a flow sensor associated with one of the valves or with an appropriate point of the tube 42. As such, when the release oil in the cartridge 30 is all used up in the manner above, the empty cartridge 30 is simply removed and a new and full cartridge snap-in loaded.

An operator, therefore, need never come into contact with the release oil container (the reservoir 38) or with the feed means including the tube 42 for delivering release oil from the reservoir 38 to the application roll 36. More importantly, no separate and independent drive means are required by the feed means 40 to positively feed release oil from the container or reservoir to the application roll 36, thereby making the cartridge and method of the present invention relatively less expensive.

Although the invention has been described in detail with reference to a particular embodiment, it is understood that modifications and variations of the embodiments can be effected within the scope and spirit of the invention as a whole.

I claim:

1. In an electrostatographic copier or printer, a fusing apparatus for fusing toner images on a receiver sheet, the fusing apparatus including:

(a) a heated fuser roller having an outside surface suitable for directly contacting and heating the toner images being fused;

(b) a pressure roller forming a fusing nip with said fuser roller; and (c) a passive release oil application cartridge for applying release oil to said outside surface of said fuser roller in order to prevent the toner images in contact therewith from offsetting to such surface, said cartridge comprising:

(i) a housing including a front wall having an opening therein;

(ii) a rotatable shaft supported in said housing adjacent said opening;

(iii) a rotatable release oil application roll for receiving and applying release oil to said outside surface of the fuser roller, said application roll being mounted fixedly to said shaft for rotation therewith, and being positioned across said opening in said front wall, said application roll further projecting partially through said opening, and frictionally contacting said outside surface of the fuser roller for applying release oil thereto, and for being driven thereby;

(iv) a reservoir of release oil mounted within an upper portion of said housing; and (v) feed means located beneath said reservoir, said feed means connecting said reservoir to said application roll, and said feed means including a flow tube and a cam driven pressure bar assembly for intermittently compressing and releasing said flow tube so as to force release oil therein into said application roll.

2. A passive release oil application cartridge for applying release oil to the outside surface of a fuser roller in an electrrostatographic copier or printer, the cartridge comprising:

(a) a housing including a front wall having an opening therein;

(b) a rotatable shaft supported in said housing adjacent said opening;

(c) a rotatable release oil application roll for receiving and applying release oil to said outside surface of the fuser roller, said application roll being mounted fixedly to said shaft for rotation therewith, and being positioned across said opening in said front wall, said application roll further projecting partially through said opening, and frictionally contacting said outside surface of the fuser roller;

(d) a reservoir of release oil mounted within an upper portion of said housing; and (e) feed means located in said housing beneath said reservoir, said feed means connecting said reservoir to said application roll, and said feed means further including:

(i) a flow tube for release oil flowing from said reservoir to said application roll; and (ii) a cam driven pressure bar assembly attached to said flow tube for intermittently compressing and releasing said tube so as to force release oil therein to flow into said application roll.

3. The release oil application cartridge of claim 2 wherein the cartridge is disposable.

4. The release oil application cartridge of claim 2 wherein said feed means further comprises:

(a) a flow tube;

(b) a one-way check valve in said tube for controlling flow, to and from said reservoir, into said tube;

(c) a cam driven pressure bar assembly attached to said tube for intermittently compressing and releasing said tube so as to force release oil therein into said application roll; and (d) a rotatable cam in constant contact with said pressure bar assembly for providing intermittent drive thereto, said cam being mounted fixedly to said rotatable shaft for rotation therewith such that rotation of said application roll by the fuser roller in turn rotates said shaft, and thereby rotating said cam and driving said pressure bar assembly.

5. The release oil application cartridge of claim 4 wherein said pressure bar assembly includes:

(a) a pressure bar having a tube compressing position and a tube release position relative to said tube, a first end in constant riding contact with said cam, and a second end for contacting and compressing one side of said tube when driven by said cam;

(b) a stationary pressure plate mounted on the other side of said tub directly across from the point of contact of said pressure bar with said tube; and (c) a return spring bar with said tube; and second end of said pressure bar for returning said pressure bar from its tube compressing position to its tube release position.

* * * * *

UNITED STATES PATENT AND TRADEMARK OFFICE

CERTIFICATE OF CORRECTION

PATENT NO. : 4,994,862

DATED : February 19, 1991

INVENTOR(S) : Christopher B. Liston

It is certified that error appears in the above-identified patent and that said Letters Patent is hereby corrected as shown below:

| | |
|---|---|
| Col. 6, line 29, Claim 5 | After "said" change "tub" to --tube--. |
| Col. 6, line 31, Claim 5 | After "spring" insert --connected to said second end of said pressure--. |
| Col. 6, lines 31-32, Claim 5 | After "bar" delete --with said tube; and second end of said pressure bar--. |

Signed and Sealed this

Sixth Day of August, 1991

*Attest:*

*Attesting Officer*

HARRY F. MANBECK, JR.

*Commissioner of Patents and Trademarks*

UNITED STATES PATENT OFFICE

CERTIFICATE OF CORRECTION

Patent No. 4,994,862 Dated February 19, 1991

Inventor(s) Linn C. Hoover

It is certified that error appears in the above-identified patent and that said Letters Patent is hereby corrected as shown below:

| | |
|---|---|
| Col. 6, line 29, Claim 5 | After "said" change "tub" to --tube--. |
| Col. 6, line 31, Claim 5 | After "spring" insert --connected to said second end of said pressure--. |
| Col. 6, line 31-32, Claim 5 | After "bar" delete --with said tube; and second end of said pressure bar--. |

This certificate supersedes Certificate of Correction issued on August 6, 1991.

Signed and Sealed this

Seventh Day of September, 1993

Bruce Lehman

*Attest:*

BRUCE LEHMAN

*Attesting Officer*

*Commissioner of Patents and Trademarks*